US006220212B1

(12) United States Patent
Wakeman

(10) Patent No.: US 6,220,212 B1
(45) Date of Patent: Apr. 24, 2001

(54) AUTOMOTIVE VALVE ROCKER ARMS

(75) Inventor: Russell John Wakeman, Canton, MI (US)

(73) Assignee: Ricardo Inc., Belleville, MI (US)

( * ) Notice: Subject to any disclaimer, the term of this patent is extended or adjusted under 35 U.S.C. 154(b) by 0 days.

(21) Appl. No.: 09/533,117

(22) Filed: Mar. 22, 2000

(30) Foreign Application Priority Data

Mar. 25, 1999 (GB) ..... 9906955

(51) Int. Cl.[7] ..... F01L 1/18; F01L 13/00

(52) U.S. Cl. ..... 123/90.16; 123/90.39; 123/308; 123/198 F

(58) Field of Search ..... 123/90.15, 90.16, 123/90.39, 90.41, 308, 198 F

(56) References Cited

U.S. PATENT DOCUMENTS 5,273,006 * 12/1993 Schapertons et al. ..... 123/90.16
5,353,756 * 10/1994 Murata et al. ..... 123/90.16
5,577,469 11/1996 Muller et al. ..... 123/90.16
5,682,847 * 11/1997 Hara ..... 123/90.16
6,016,779 * 1/2000 Nemoto et al. ..... 123/90.16
6,058,895 * 5/2000 Hermsen ..... 123/90.16
6,085,707 * 7/2000 Nemoto et al. ..... 123/90.16

* cited by examiner

*Primary Examiner*—Weilun Lo
(74) *Attorney, Agent, or Firm*—Rosenthal & Osha L.L.P.

(57) ABSTRACT

An automotive valve rocker arm comprises a valve engagement portion and a cam engagement portion which are mounted for independent rocking movement about a rocker shaft. One of the cam engagement portion and valve engagement portion affords a first bush, which accommodates and is rotatable about the rocker shaft, and the other of which affords a second bush, which accommodates the first bush and is rotatable about the first bush and thus about the rocker shaft also. Selectively actuable locking means are accommodated within the space defined by the outer surface of the second bush and are movable between a first position in which relative movement of the valve engagement portion and the cam engagement portion is permitted and a second position in which they are locked together and such relative movement is prevented.

4 Claims, 2 Drawing Sheets

AUTOMOTIVE VALVE ROCKER ARMS

FIELD OF THE INVENTION

The present invention relates to automotive valve rocker arms. Such rocker arms are of course well known and form part of the mechanism in automotive engines by which the exhaust and inlet valves of the engine are opened and closed. More specifically, the invention relates to automotive valve rocker arms comprising an elongate lever which comprises a valve engagment portion and a cam engagement portion and is mounted at a position intermediate its ends to rock about a rocker shaft transverse to its length.

In use, the cam engagement region is engaged periodically by the associated cam, either directly or indirectly via a push rod and/or tappet which results in movement of the associated end of the rocker arm in one direction and thus in rocking or pivotal movement of the rocker arm about the rocking axis. This results in movement of the other end of the rocker arm and thus of the valve engagement region in the opposite direction and the valve engagement region bears against the stem of the associated valve and moves it, e.g. into the open position.

DESCRIPTION OF THE PRIOR ART

Continuing pressure for improved fuel economy is leading automotive engine manufacturers to seek improved engine technologies which can lower fuel consumption. These include the ability to disable selected valves or selected cylinders during low load operation. In the case of an engine with two or more inlet valves of swirl-inducing type per cylinder, the swirling velocity of the air or air/fuel mixture within the cylinder may drop to unacceptably low levels at low engine loads, thereby resulting in incomplete combustion or increased emission levels. It is known to counteract this problem by disabling one of the inlet valves, that is to say ensuring that it does not open or close with the other inlet valve(s), whereby the air speed through the other inlet valve(s) is increased and the swirling velocity of the air within the cylinder is increased also. It is also known to disable entire cylinders, that is to say to disable all the inlet valves associated with a selected cylinder so that the cylinder in question does not contribute at all to the power output of the engine at low load. This increases fuel economy because it permits the engine to operate with the throttle more widely open than would otherwise be the case, thereby reducing pumping losses. Pumping losses are further reduced if the exhaust valve(s) associated with the disabled cylinder are also disabled. The fuel supply and ignition associated with the disabled cylinder are preferably also disabled.

Whilst the technique of selective valve or cylinder disablement has been shown to be effective, very few engines with this feature have actually been produced commercially. The reason for this is that the deactivation mechanisms are complex and costly and typically require an additional actuator for each cylinder or valve that is to be disabled.

It is therefore the object of the invention to provide a valve actuation mechanism, specifically a rocker arm, which is cheap, simple and reliable and may be used to disable selected valves of an automotive engine and in which only a single actuator is required for disabling a number of valves or cylinders.

SUMMARY OF THE INVENTION

According to the present invention an automotive valve rocker arm of the type referred to above is characterised in that the valve engagement portion and the cam engagement portion constitutes separate, relatively movable components and selectively actuable locking means are provided which are movable between a first position in which relative movement of the valve engagement portion and the cam engagement portion is permitted and a second position in which they are locked together and such relative movement is prevented.

Thus the rocker arm in accordance with the invention does not constitute a single unitary component, as is conventional, but constitutes two separate components which may be selectively locked together, which means that they will then act as a single component, or may be unlocked, in which event they are capable of independent movement and the force transmitted by the cam to one end of the rocker arm is not transmitted through to the associated valve, whereby the associated valve is disabled.

It is preferred that the valve engagement portion and the cam engagement portion are mounted for independent rocking movement about the rocker shaft. This may be effected in a number of ways but in the preferred embodiment one of the cam engagement portion and the valve engagement portion affords a first bush or sleeve which accommodates and is rotatable about the rocker shaft and the other of which affords a second bush or sleeve which accommodates the first bush or sleeve and is rotatable about the first bush or sleeve and thus about the rocker shaft also.

In one embodiment, the first bush has an aperture formed therein which accommodates a locking member and is in registry with a recess in the inner surface of the second bush, in one relative position of the valve engagement portion and the cam engagement portion, and the locking means includes a lock actuator arranged to move the locking member between a locked position in which it is accommodated in both the aperture and the recess and thus locks the cam engagement portion and the valve engagement portion together and an unlocked position in which it is not within the recess and relative pivotal movement of the cam engagement portion and the valve engagement portion is thus possible.

The locking member and the aperture partially accommodating it may take various forms and there may be one locking member provided for each rocker arm or two or more such locking members. In the preferred embodiment, the aperture in the first bush is elongate in the direction of the length of the rocker shaft and the locking member comprises a pin or roller.

It is preferred that the rocker shaft is rotatable about its axis and has a recess in its outer periphery and constitutes the lock actuator, the rocker shaft being rotatable between an unlocked position in which the locking member is accommodated in both the aperture and the recess in the rocker shaft and a locked position in which the locking member is not accommodated within the recess in the rocker shaft. In the preferred embodiment the recess in the rocker shaft extends in the peripheral direction and is of progressively increasing depth in that direction.

The invention also embraces an internal combustion engine of reciprocating piston type including one or more such rocker arms. These rocker arms may be used selectively to disable one of two or more inlet valves per cylinder at low engine loads so as to increase the velocity of air flow through the remaining inlet valves. Thus the invention embraces such engine having a plurality of cylinders, each of which has two inlet valves and at least one exhaust valve, at least one inlet valve of each cylinder being operated by a cam shaft via a respective rocker arm of the type referred to above mounted on a common rocker shaft, the rocker shaft having a respective recess in its outer periphery associated with each said rocker arm and being connected to a rotary actuator, the recesses in the rocker shaft being so positioned that the rocker shaft is rotatable between a position in which all the rocker arms associated with the said one inlet valves are locked and a position in which the two portions of all the said rocker arms are capable of relative movement, whereby the said one inlet valves are all disabled.

The rocker arm in accordance with the present invention also finds application in an engine of reciprocating piston type with a plurality of cylinders for the purpose of selectively disabling one or more entire cylinders. Thus the invention embraces such an engine in which each cylinder has at least one inlet valve and at least one exhaust valve, all the inlet valves, and preferably all the exhaust valves also, associated with at least one cylinder being operated by a cam shaft via respective rocker arms of the type referred to above mounted on a common rocker shaft, the rocker shaft being connected to a respective rotary actuator, the recesses in the rocker shaft being so positioned that the rocker shaft is rotatable between a position in which all the rocker arms associated with the said one cylinder are locked and a position in which the two portions of all the said rocker arms are capable of relative movement and the cylinder is thus disabled.

It may of course be required either to disable a selected one of two or more cylinders or to disable two or more cylinders at the same time. In this event, all the valves associated with two or more cylinders will be operated via respective rocker arms of the type referred to above, the recesses in the rocker shaft associated with each cylinder being angularly offset and/or of different size from those associated with the other cylinders, whereby a selected one and/or a selected number of the cylinders may be disabled.

Further features and details of the invention will be apparent from the following description of one specific embodiment of rocker arm in accordance with the invention which is given by way of example only with reference to the accompanying drawings.

DESCRIPTION OF THE PREFERRED EMBODIMENT

Figure 1:
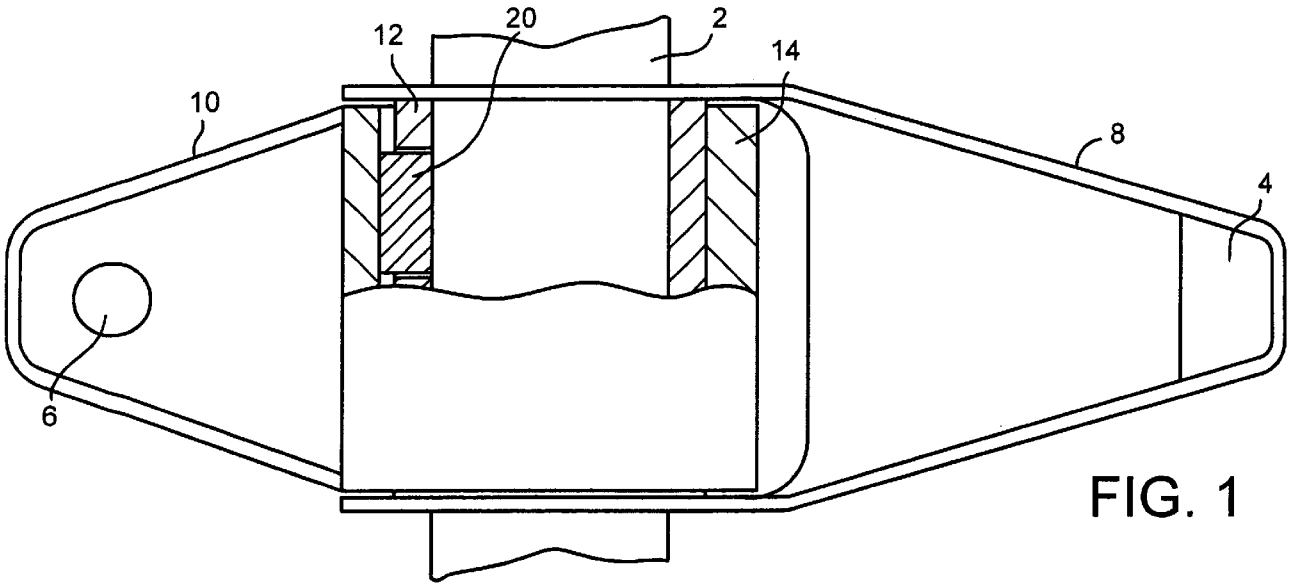
FIG. 1 is a partly cut-away plan view of the rocker arm in the locked condition.

The rocker comprises an elongate lever which is mounted to rock or pivot about a rocker shaft 2 which extends perpendicular to its length. The underside of one end of the lever constitutes a valve engagement region 4 which, in use, engages the upper end of the stem of an automotive inlet or an exhaust valve and the underside of the other end of the lever constitutes a cam engagement region 6 which engages a cam (not shown), in this case indirectly via a pushrod (also not shown). The lever is divided transverse to its length into two portions, a valve engagement portion 8 and a cam engagement portion 10, each of which is mounted independently for rocking or pivotal movement about the shaft 2. At its inner end the valve engagement portion 8 affords an integral bush 12 defining a bore in which the shaft 2 is received with substantially no clearance such that the valve engagement portion is hinged about the shaft 2. At its inner end the cam engagement portion 10 affords an integral bush 14 defining a bore in which the bush 12 is received with substantially no clearance such that the cam engagement portion is hinged about the bush 12 and may thus also rotate about the axis of the shaft 2.

Figure 2:
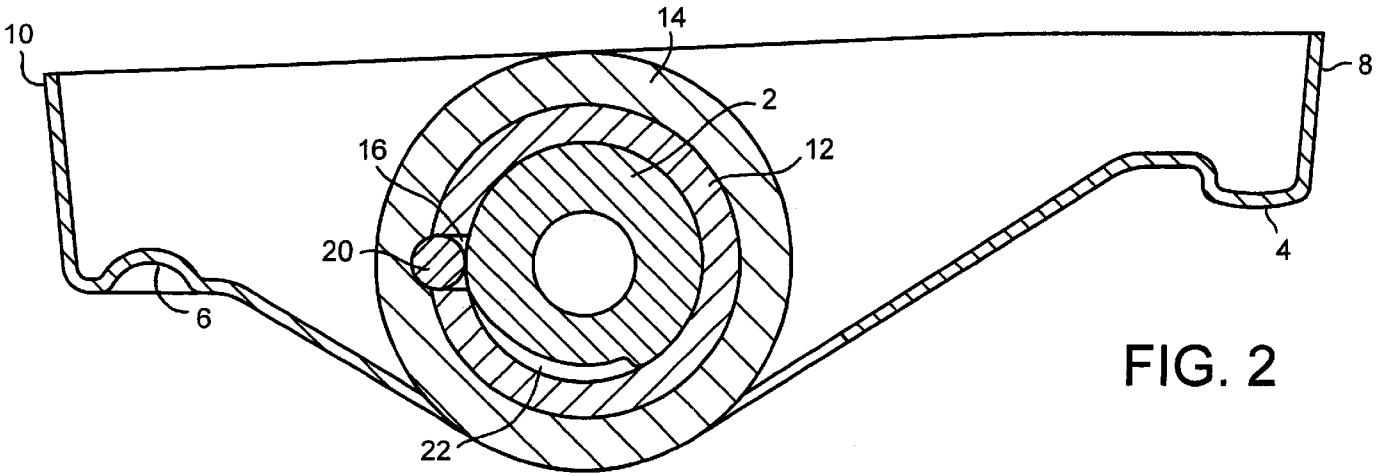
FIG. 2 is a longitudinal central sectional elevation of the rocker arm shown in FIG. 1.
Figure 3:
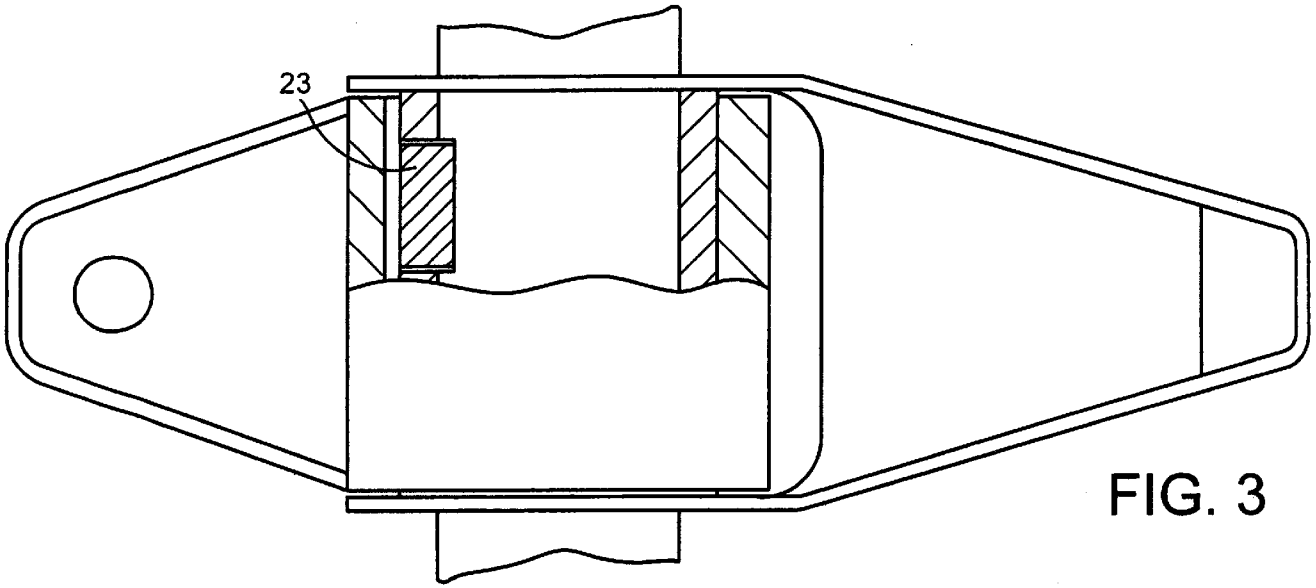
FIGS. 3 and 4 are views corresponding to FIGS. 1 and 2, respectively, showing the rocker arm in the unlocked condition.
Figure 4:
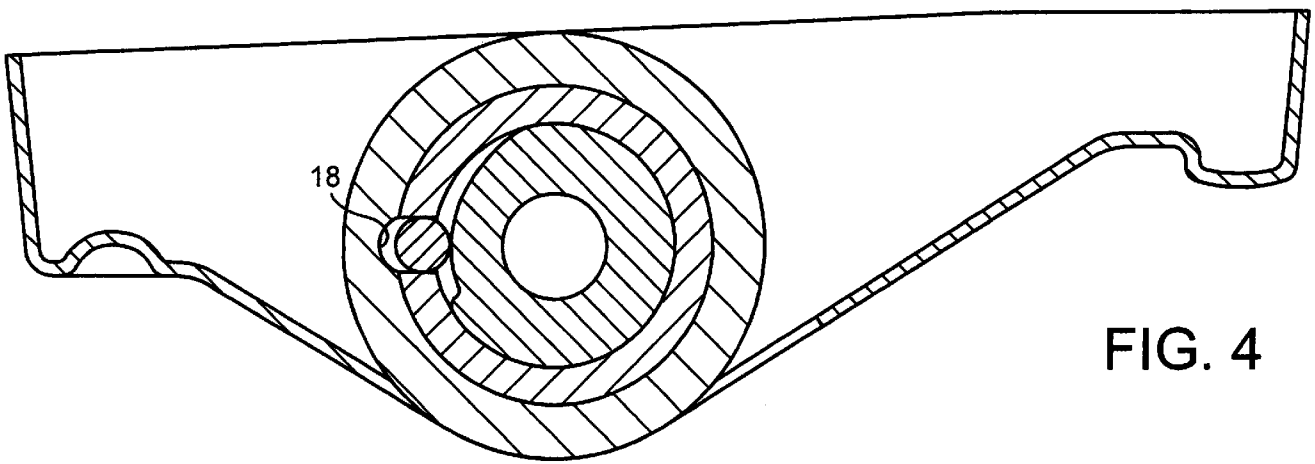

A slot 16 extending parallel to the rocker shaft 2 is formed through the wall of the bush 12 extending over a proportion of its length. Formed in the inner wall of the bush 14, in alignment with the slot 16 when the cam engagement portion 10 and valve engagement portion 8 are in alignment, is a part-cylindrical recess 18 whose length is at least as great as that of the slot 16. Accommodated in part in the slot 16 is a cylinder or pin 20, whose diameter is greater than the thickness of the bush 12. As seen in FIGS. 2 and 4, the rocker shaft 2 is not of truly circular shape over its entire length but is formed with a recess 22 in the vicinity of the slot 16. This recess extends over about 90° in the present case and its depth is constant in the axial direction but progressively increases in the circumferential direction from a value of zero to a value which is substantially equal to the depth of the recess 18.

Rocker shafts are conventionally stationary and fixed in their mountings but in the present case the rocker shaft 2 is rotatably mounted in its mountings and an actuator (not shown), e.g. a stepper motor, torque motor or hydraulic actuator, is connected to it to rotate it between two predetermined positions, i.e. the positions shown in FIGS. 2 and 4. In the position shown in FIG. 2, the recess 22 is not aligned with the pin 20 and the inner surface of the pin 2 is therefore constrained to be at a position which lies on the circle defined by the internal surface of the bush 12. The bushes 12 and 14 and thus the valve and cam engagement portions 4, 6 are locked together and the rocker arm acts as a single component, whereby rocking movement of the cam engagement portion is transmitted to the valve engagement portion and the associated valve is opened and closed in the conventional manner. As the shaft 2 is rotated towards the position shown in FIG. 2, the pin 20 is progressively forced out of the recess 18 and into the recess 22 in contact with the floor of the recess 22. When the shaft 2 is in the position shown in FIG. 4, the pin 20 is fully disengaged from the recess 18 and the bushes 12 and 14 are no longer connected. Accordingly, the two portions of the rocker arm may rock independently and rocking motion of the cam engagement portion 6 is not transmitted to the valve engagement portion 4 and the valve with which the rocker arm is associated is no longer opened and closed.

If it is desired merely to disable one inlet valve of two or more such valves communicating with a cylinder, the valve associated with the rocker arm will be an inlet valve. In this event at least one of the other inlet valves will not have means that permit it to be disabled. If it is desired to disable an entire cylinder, each inlet valve, and preferably also each exhaust valve, associated with that cylinder will be associated with a similar rocking arm and all the recesses 22 will be in the same angular position, whereby rotation of the rocker shaft to the desired position will result in all the valves being disabled at the same time.

The rocker shaft actuator will be actuated in response to commands issued by the engine management system, with which most automotive engines are now provided, in response to a determination that the engine load has fallen below a predetermined level.

In a multi-cylinder engine it may be desirable to be able to disable two or even more cylinders as the engine load progressively falls and this may readily be achieved by providing all the recesses 22 associated with each cylinder which is to be disabled at different angular positions on the or each rocker shaft to those associated with the other cylinders. Thus rotation of the rocker shaft to a first position may result in disablement of a first cylinder and rotation to a second and subsequent position may result in the additional disablement of second and subsequent cylinders. Rotation of the rocker shaft in the reverse direction will result in the re-enablement of the cylinders in the reverse order. In this event it is of course necessary that the recesses 22 associated with the different cylinders start at different positions but overlap angularly. Alternatively, if the recesses 22 associated with the different cylinders do not overlap at all, only one cylinder will be disabled at any one time and the cylinder to be disabled is selected by appropriately positioning the rocker shaft. Those cylinders which are never to be disabled are associated with conventional rocker arms which rock regardless of the angular position of the rocker shaft.

When a particular valve is disabled, the valvetrain is no longer preloaded by the valve spring. There is therefore a potential problem of the cam engagement portion of the rocker arm, the tappet (if provided) and the pushrod or cam losing contact. This may be prevented by providing a spring acting on the cam engagement portion of the rocker. e.g. a torsion spring extending around the rocker shaft, to bias it into contact with the associated cam or pushrod. It is preferred that this spring also acts on the valve engagement portion of the rocker arm and biases it into contact with the valve. When the two halves of the rocker arm are locked together, the spring will simply rock with it and add no forces to the valve motion.

In practice, actuation of the actuator will take place when the base circle of the or each cam is in contact with the associated rocker arm, that is to say when the associated valve is not open, so as to minimise stresses and shocks on the valve train.

What is claimed is:

1. An automotive valve rocker arm comprising an elongate lever, said elongate lever comprising a valve engagement portion and a cam engagement portion, both of which are mounted for independent rocking movement about a rocker shaft, one of said cam engagement portion and said valve engagement portion affording a first bush, which accommodates and is rotatable about said rocker shaft, and the other of said cam engagement portion and said valve engagement portion affording a second bush, which has an inner surface and an outer surface defining a space therein and accommodates said first bush and is rotatable about said first bush and thus about said rocker shaft also, and selectively actuable locking means which is provided within said space defined by said outer surface of said second bush and which is movable between a first position, in which relative movement of said valve engagement portion and said cam engagement portion is permitted, and a second position in which said valve engagement portion and said cam engagement portion are locked together and said relative movement is prevented;

wherein said first bush defines an aperture therein, said inner surface of said second bush defines a recess therein and said locking means includes a locking member and a locking actuator, said aperture at least partially accommodating said locking member and said aperture being in registry with said recess, in one relative position of said valve engagement portion and said cam engagement portion, and said lock actuator is arranged to move said locking member between a position in which it is accommodated in both said aperture and said recess and thus locks said cam engagement portion and said valve engagement portion together and an unlocked position in which it is not within said recess and relative pivotal movement of said cam engagement portion and said valve engagement portion is thus possible.

2. A rocker arm as claimed in claim 1 in which said aperture in said first bush is elongate in the direction of said length of said rocker shaft and said locking member comprises a pin or roller.

3. A rocker arm as claimed in claim 2 in which said rocker shaft is rotatable about said axis and has a recess in said outer periphery and constitutes said lock actuator, said rocker shaft being rotatable between an unlocked position in which said locking member is accommodated in both said aperture and said recess in said rocker shaft and a locked position in which said locking member is accommodated in said aperture and said recess in the second bush and not within said recess in said rocker shaft.

4. A rocker arm as claimed in claim 3 in which said recess in the rocker shaft extends in the direction of said outer periphery and is of progressively increasing depth in that direction.

* * * * *